US005534643A

United States Patent [19]

Endou et al.

[11] Patent Number: 5,534,643

[45] Date of Patent: Jul. 9, 1996

[54] SURFACE-TREATING AGENT FOR METAL CAN AND METHOD FOR TREATING METAL CANSURFACE

[75] Inventors: Syunichi Endou; Satoshi Miyamoto, both of Osaka; Kaoru Komiya; Naomi Koishikawa, both of Tokyo, all of Japan

[73] Assignees: Nippon Paint Co., Ltd., Osaka; Asahi Denka Kogyo Kabushiki Kaisha, Tokyo, Japan

[21] Appl. No.: 186,516

[22] Filed: Jan. 26, 1994

[30] Foreign Application Priority Data

Jan. 29, 1993 [JP] Japan ..... 5-013182

[51] Int. Cl.[6] ..... C07C 57/00

[52] U.S. Cl. ..... 554/227; 148/243

[58] Field of Search ..... 554/227

[56] References Cited

U.S. PATENT DOCUMENTS

| | | | |
|---|---|---|---|
| 2,685,521 | 8/1954 | Edgar | 106/244 |
| 3,278,321 | 10/1966 | Hazdra | 106/243 |
| 3,782,970 | 1/1974 | Tomita et al. | 426/602 |
| 4,073,412 | 2/1978 | Doumani | 106/244 |
| 4,212,750 | 7/1980 | Gorman | 252/32.5 |
| 4,637,885 | 1/1987 | Kuwamoto et al. | 252/32.5 |
| 4,859,351 | 8/1989 | Awad | 252/32.5 |
| 5,082,684 | 1/1992 | Fung | 426/602 |
| 5,217,742 | 6/1993 | Jones et al. | 426/602 |
| 5,247,114 | 9/1993 | Jakobson et al. | 554/227 |

FOREIGN PATENT DOCUMENTS

| | | |
|---|---|---|
| 0293820 | 12/1988 | European Pat. Off. . |
| 0346717 | 12/1989 | European Pat. Off. . |
| 0508418 | 10/1992 | European Pat. Off. . |
| 52-12207 | 4/1977 | Japan . |
| 59-210971 | 11/1984 | Japan . |
| 61-74541 | 4/1986 | Japan . |
| 61-166372 | 7/1986 | Japan . |
| 63-44936 | 2/1988 | Japan . |
| 64-85292 | 3/1989 | Japan . |
| 5-287292 | 11/1993 | Japan . |
| WO-A-8103293 | 11/1981 | WIPO . |

OTHER PUBLICATIONS

DATABASE WPI, Section Ch, Week 8801, Derwent Publications Ltd., London, GB; Class A97, AN 88–004792 & JP–A–62 270 443 (Yamamura Glass) Nov. 24, 1987 (abstract).

DATABASE WPI, Section Ch, Week 8430, Derwent Publications Ltd., London, GB; Class A82, AN 84–185817 & JP–A–59 105 094 (Kishimoto A) Jun. 18, 1984, abstract.

*Primary Examiner*—José G. Dees
*Assistant Examiner*—Deborah D. Carr
*Attorney, Agent, or Firm*—Armstrong, Westerman, Hattori, McLeland & Naughton

[57] ABSTRACT

The invention provides a surface-treating agent for a metal can, which diminishes friction on an outside surface of the can without giving a bad influence on attachability of paint, lacquer and the like and shows high safety to the human body. Furthermore, the invention provides a method for treating a metal can surface with said surface-treating agent. The surface-treating agent for a metal can is characterized by containing an ester compound between a polyglycerol and fatty acid(s) as an essential component. To diminish a friction coefficient of the metal can surface, the surface-treating agent is brought into contact with the metal can surface.

4 Claims, No Drawings

SURFACE-TREATING AGENT FOR METAL CAN AND METHOD FOR TREATING METAL CANSURFACE

BACKGROUND OF THE INVENTION

The present invention relates to a surface-treating agent for a metal can and a method for treating a metal can surface, which are applied to a metal can surface to diminish friction on the surface and thereby, bring about a surface condition preferable to production of the can. In detail, the invention relates to a surface-treating agent for a metal can and a method for treating a metal can surface, which diminish friction on an outside surface of the metal can, especially an aluminum can, without giving a bad influence on attachability of paint or lacquer and thereby, which can improve mobility on a conveyor.

The metal can is used as a vessel for various products and, especially, the aluminum can is widely used as the most common metal can. Hereinafter, the aluminum can is cited as an example and explained.

The aluminum can is washed by an acid cleaner and the like to remove fine aluminum powder and other contaminators after the can main body is produced. However, recently, because of environmental problems and because an acid liquid remaining on the can after washing by acid gives a bad influence on the smell of can contents, removal of fine powder and other contaminators by washing by alkali has been desired.

However, if the washing by alkali is carried out to remove fine powder in an inside of the aluminum can, an outside surface of the can becomes coarse in such condition and the can does not smoothly move on a belt conveyor in a process to fill the can contents, a process to print the can surface and other processes, so that the following problems occur: the mis-supply of cans, productivity decease, increase in the can-losing ratio, and the like.

Therefore, it is desired to diminish the friction on an outside surface of the can without giving a bad influence on attachability of paint, lacquer and the like to the outside can surface.

Japanese Official Patent Provisional Publication (Kokai) No. showa 64-85292 describes phosphoric acid esters, ethylene oxide adducts of fatty acids, ethylene oxide adducts of higher alcohols and the like as surface-treating agents for a metal can, to solve the above-mentioned problems.

However, since the aluminum can and the like are often used for food articles and since the above-mentioned compounds have a problem in safety to the human body, the compounds cannot be used as a widely used surface-treating agent for a metal can.

SUMMARY OF THE INVENTION

Accordingly, it is an object of the present invention to provide a surface-treating agent for a metal can, which diminishes the friction on an outside surface of the can without giving a bad influence on attachability of paint, lacquer and the like, and which shows high safety to the human body. Furthermore, it is another object of the present invention to provide a method for treating a metal can surface with said surface-treating agent.

To solve the above-mentioned problems, a surface-treating agent for a metal can relating to the present invention is characterized by containing an ester compound between a polyglycerol and fatty acid(s) as an essential component.

Furthermore, to solve the above problems, a method for treating a metal can surface, relating to the present invention, comprises the step of bringing a surface-treating agent for a metal can into contact with a metal can surface in order to diminish a friction coefficient of the metal can surface, said surface-treating agent containing an ester compound between a polyglycerol and fatty acid(s) as an essential component.

The ester compound used for the surface-treating agent can be obtained by esterifying the polyglycerol with fatty acid(s) by a method known in public.

Here, the term "fatty acid(s)" means one kind of fatty acid or two or more kinds of fatty acids. That is, the above-mentioned ester compound may be either such as obtained by a reaction of only one kind of fatty acid with one molecule of polyglycerol or such as obtained by a reaction of two or more kinds of fatty acids with one molecule of polyglycerol.

The polyglycerol used to obtain the surface-treating agent is not especially limited. However, it is preferable to use a polyglycerol having a polymerization degree of 2 to 30 and more preferably, 6 to 20. In practice there are cited, for example, diglycerol, triglycerol, tetraglycerol, pentaglycerol, hexaglycerol, heptaglycerol, octaglycerol, nonaglycerol and the like. The polyglycerol may be used as one kind alone or in combination of two or more kinds.

If the polymerization degree of polyglycerols is less than 2, there is a case where solubility-in-water or dispersibility-in-water of an ester compound obtained by the fatty acid esterification is badly influenced. If the polymerization degree is more than 30, there is a case where the lubricativity of an obtaining surface-treating agent becomes bad due to very high solubility-in-water of the agent.

The fatty acid used to obtain the surface-treating agent is not especially limited. Any fatty acid of a straight chain type, branch type, saturated type and unsaturated type may be used and, furthermore, two or more of these types may be used in combination. The carbon atom number of fatty acids is preferably in a range of 10 to 30 and more preferably, 14 to 22. In practice there are cited, for example, capric acid, lauric acid, myristic acid, palmitic acid, stearic acid, oleic acid, isostearic acid and the like. The fatty acid may be used as one kind alone or in combination of two or more kinds.

If the carbon atom number of fatty acids is less than 10, the diminution of friction on the outside can surface becomes insufficient and, if the number is more than 30, the solubility-in-water suffers a bad influence. Furthermore, the above-mentioned fatty acids have preferably an iodine value of 20 or less and more preferably, 10 or less, in respect of the lubricativity of an obtaining surface-treating agent.

The esterification between a polyglycerol and fatty acid(s) is preferably carried out in such a manner that a resulting polyglycerol fatty acid ester has the solubility-in-water or dispersibility-in-water. A ratio of the number of ester groups resulting from esterification with a fatty acid versus the total number of residual unreacted hydroxyl groups of a polyglycerol used and the ester groups resulting from esterification with the fatty acid, that is, an esterified ratio, is preferably in a range of 1 to 30%, more preferably 3 to 25%, and still more preferably 5 to 20%.

In a case where the esterification is practically carried out, the esterified ratio is scattering at every molecule and, in many cases, molecules having high esterified ratios and molecules having low ones (occasionally, unesterified molecules) coexist in a mixture condition. Even in such a case, the esterified ratio in this reaction system, that is, the ratio of the number of ester groups resulting from esterification with a fatty acid versus the total number of the ester groups resulting from esterification with the fatty acid and the residual unreacted hydroxyl groups of all the esterified and unesterified polyglycerol molecules in the system have, is desired to be in the above-mentioned range.

However, even in the above case, it is desired that each molecule of the esterified polyglycerol fatty acid ester has the solubility-in-water or dispersibility-in-water.

If the esterified ratio is more than 30%, the ester becomes sparingly soluble in water, so that an application to the can surface becomes difficult. If the esterified ratio is less than 1%, the diminution of friction on the outside can surface is unpreferably insufficient.

Furthermore, as occasion demands, the surface-treating agent for a metal can may be used together with another lubricant, a stabilizer, an antimicrobial agent and the like in a range not deviating from the object of present invention.

The surface-treating agent can be applied to any process to produce a metal can as well as applied before and after this process. Furthermore, the surface-treating agent can be applied to a process which is carried out after the process to produce a metal can, but before a filling or printing process for the metal can. In applying the surface-treating agent, any method hitherto known in public may be used. For example, the surface-treating agent may be diluted by water or a water-soluble solvent (water is preferable in respect of the sanitary problems) and applied by a spray, a roller and the like.

It is preferable that the surface-treating agent of the present invention is used by such an amount that the static friction coefficient of the outside can surface is 1.5 or less. In practice, for example, the surface-treating agent is preferably used by an amount of about 3 to 60 mg (as a pure component of the polyglycerol fatty acid ester) per 1 $m^2$ of the outside can surface.

The polyglycerol fatty acid ester used for the surface-treating agent for a metal can in the present invention has been permitted as a food additive and it is a compound showing high safety to the human body. Accordingly, the surface-treating agent may be also applied to a metal can for food, so that it is of wide use. Furthermore, the surface-treating agent reacts with the outside surface of a metal can (especially, that of an aluminum can) by the chemical or physical adsorption to form a thin film of an organic substance. This film acts as a lubricant to diminish the static friction coefficient. Furthermore, the surface-treating agent does not give a bad influence on the attachability of paint or lacquer, which is going to be coated on the can.

In the present invention, because the surface-treating agent for a metal can uses, as an essential component, a compound officially permitted as a food additive, it shows high safety to the human body, even in a case where it is used to process a metal can for food. Furthermore, because the surface-treating agent diminishes the static friction coefficient of the outside can surface, the mobility of cans is improved and the productivity in producing a metal can is enhanced. Furthermore, the surface-treating agent does not give a bad influence on the attachability of paint or lacquer in the printing process.

DESCRIPTION OF THE PREFERRED EMBODIMENTS

Hereinafter, the present invention is illustrated by the following examples of some preferred embodiments in comparison with comparative examples not according to the invention.

EXAMPLES 1 to 8 and COMPARATIVE EXAMPLE 1

An aluminum can not yet washed was washed at 75° C. for 60 seconds by using an acid cleaner (Surf Cleaner NHC-100, made by Nippon Paint Co., Ltd.; pH 1). For the washing, a miniature washer (treating ability: 14 cans) of a laboratory use was used. In a rinsing step which was final in the washing process, the aluminum can was treated with hexaglycerol-oleic acid monoester as a surface-treating agent for a metal can in such an amount as shown in the undermentioned TABLE 1 and the treated can was dried in an oven. For the treated can, the mobility in a can-producing line and the paint-attachability on coating were evaluated according to the following standards.

Mobility:

Static friction coefficients of the outside can surfaces were measured by using a static friction coefficient test machine, a HEIDON-14 model of a laboratory use.

Paint-attachability:

A set was made from four to six cans, coated after treating the surfaces, and this set was exposed to the following test solution A or B for 20 minutes.

Test solution A:

A 1% aqueous solution of Joy (solution type of dish cleaner, made by Procter & Gamble Co.), of which solvent was composed of a 3:1 mixture of ion-exchanged water and tap water and of which temperature was 80° C.

Test solution B:

A 1% aqueous solution of the Joy, of which solvent was composed of ion-exchanged water and of which temperature was 100° C.

Next, a line was drawn sidewise on each can by a keen metal cutter so that an aluminum line could be seen through paint or lacquer. On the line, a transparent tape (Scotch No. 610, made by 3M Co.) was firmly attached and then, rapidly pulled off. This test was carried out for an outer side wall, inner side wall and inner bottom of the can. The results were evaluated as follows.

10: Perfect. The paint was not peeled off from the can surface at all.

8: Practically no problem.

0: The paint was entirely peeled off in the tape width.

Average values of the above results are shown in TABLE 1.

TABLE I

| | Concentration of surface-treating agent for metal can (% by vol.) | Solution | Outer side wall | Inner side wall | Inner bottom | Static friction coefficient |
|---|---|---|---|---|---|---|
| EXAMPLE 1 | 0.1 | B | 10 | 10 | 10 | 0.941 |
| EXAMPLE 2 | 0.25 | A | 10 | 10 | 10 | 0.882 |
| EXAMPLE 3 | 0.5 | B | 9.5 | 10 | 10 | 0.801 |
| EXAMPLE 4 | 0.75 | A | 10 | 10 | 10 | 0.630 |
| EXAMPLE 5 | 1.0 | B | 10 | 10 | 10 | 0.643 |
| EXAMPLE 6 | 2.0 | A | 10 | 10 | 10 | 0.566 |
| EXAMPLE 7 | 5.0 | B | 10 | 10 | 10 | 0.547 |

TABLE I-continued

| | Concentration of surface-treating agent for metal can (% by vol.) | Solution | Outer side wall | Inner side wall | Inner bottom | Static friction coefficient |
|---|---|---|---|---|---|---|
| EXAMPLE 8 | 10.0 | A | 9.8 | 10 | 10 | 0.560 |
| COMPARATIVE EXAMPLE 1 | Not treated | — | — | — | — | 1.422 |

As seen in TABLE 1, it was understood that, for the cans to which the surface-treating agent was applied, the static friction coefficient of the outside can surface was diminished, the mobility was improved and the attachability of paint was not influenced. Furthermore, the surface-treating agent, even if its concentration was very low, gave sufficient effects and, in addition, even if the tests were carried out 20 to 100 times, the attachability was not influenced. Furthermore, EXAMPLES 3 and 8 show that almost no peeling-off of the paint was seen on the outer side wall.

EXAMPLE 9

An aluminum can was washed at 50° C. for 60 seconds by using an acid cleaner (Surf Cleaner 124C, made by Nippon Paint Co., Ltd.; pH 1.1) and treated with a non-chromate conversion coating (trade name A1 Surf). The static friction coefficient of the treated outside can surface was about 1.63. The printing rate on the can-producing lines could be increased up to 1150 to 1200 cans/minute without cans being unpreferably jammed.

Next, the aluminum can was treated with an ion-exchanged water-based can washer to which the surface-treating agent used in the aforementioned EXAMPLES was added in an amount of about 1.1 ml/l. The static friction coefficient of the treated outside can surface showed an 11% diminution as compared with that of before the treatment. The attachability of paint or lacquer was not influenced by the surface-treating agent. Furthermore, the static friction coefficient could be diminished by a 20% extent by increasing concentration of the surface-treating agent without influencing the attachability of paint or lacquer. The printing rate could be increased up to 1250 to 1260 cans/minute which is a mechanical limit. Furthermore, the printing rate of 1250 cans/minute could be maintained for continuous 24 hours.

EXAMPLES 10 to 12

An aluminum can was washed by the same acid cleaner as used in EXAMPLE 9 under the same conditions. After rinsing, the can was treated with any one of the following surface-treating agents for a metal can.

Treating agent 1:

An aqueous solution of the hexaglycerol-capric acid ester was used, of which concentration was 0.5 g/liter (hexaglycerol:capric acid=1:1 by mol).

Treating agent 2:

An aqueous solution of the hexaglycerol-oleic acid ester was used, of which concentration was 0.5 g/liter (hexaglycerol:oleic acid=1:1 by mol).

Treating agent 3:

An aqueous solution of the hexaglycerol-oleic acid ester was used, of which concentration was 1.5 g/liter (hexaglycerol:oleic acid=1:1 by mol).

The mobility of the treated cans was evaluated in a manner similar to EXAMPLES 1 to 8. The results are shown in TABLE 2.

TABLE 2

| | Treating agent | Static friction coefficient |
|---|---|---|
| EXAMPLE 10 | 1 | 0.476 |
| EXAMPLE 11 | 2 | 0.630 |
| EXAMPLE 12 | 3 | 0.770 |

EXAMPLES 13 to 15 and COMPARATIVE EXAMPLE 2

Generally, no water break on the can surface is desirable. That is, it is desirable that the can surface is covered with a continuous thin film of water. If there is the water break, large water drops are formed and the water film on the can surface is nonuniform and discontinuous. The can surfaces treated with each solution of EXAMPLES 10 to 12 were entirely covered with the water break and, therefore, an influence on the printing by this covering may be considered. Accordingly, the attachability of paint was evaluated as follows.

The printed can was cut to open and treated with a boiling 1% aqueous Joy solution (ion-exchanged water:tap water=3:1) for 10 minutes. Next, the can was rinsed in deionized water and dried to evaluate the attachability of paint in a manner similar to EXAMPLES 1 to 8. The results are shown in TABLE 3.

TABLE 3

| | Treating agent | Outer side wall | Inner side wall | Inner bottom |
|---|---|---|---|---|
| EXAMPLE 13 | 1 | 9.8 | 9.8 | 10 |
| EXAMPLE 14 | 2 | 9.8 | 10 | 10 |
| EXAMPLE 15 | 3 | 10 | 10 | 10 |
| COMPARATIVE EXAMPLE 2 | — | 10 | 10 | 10 |

What is claimed is:

1. A surface-treating agent for a metal can, comprising polyglyceride esters of fatty acids, said polyglyceride esters having a polymerization degree of 6 to 20 and an esterified ratio of 5 to 20%.

2. A surface-treating agent for a metal can as claimed in claim 1, wherein the polyglyceride esters of fatty acids are obtained from at least one polyglycerol selected from the group consisting of hexaglycerol, heptaglycerol, octaglycerol and nonaglycerol.

3. A surface-treating agent for a metal can as claimed in claim 1, wherein the fatty acids are at least one member selected from the group consisting of capric acid, lauric acid, myristic acid, palmitic acid, stearic acid, oleic acid and isostearic acid.

4. A surface-treating agent for a metal can as claimed in claim 1, which is diluted by water.

* * * * *